US009937940B2

(12) United States Patent
Dommel

(10) Patent No.: US 9,937,940 B2
(45) Date of Patent: Apr. 10, 2018

(54) APPARATUS FOR GENERATING ACTION RECOMMENDATIONS FOR THE DRIVER OF A RAIL VEHICLE

(71) Applicant: SIEMENS AKTIENGESELLSCHAFT, Munich (DE)

(72) Inventor: Christoph Dommel, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 47 days.

(21) Appl. No.: 14/893,954

(22) PCT Filed: May 21, 2014

(86) PCT No.: PCT/EP2014/060394
§ 371 (c)(1),
(2) Date: Nov. 25, 2015

(87) PCT Pub. No.: WO2014/191269
PCT Pub. Date: Dec. 4, 2014

(65) Prior Publication Data

US 2016/0107665 A1 Apr. 21, 2016

(30) Foreign Application Priority Data

May 29, 2013 (DE) ..... 10 2013 210 063

(51) Int. Cl.
*B61L 3/00* (2006.01)
*B61L 99/00* (2006.01)
(Continued)

(52) U.S. Cl.
CPC ..... *B61L 99/00* (2013.01); *B61L 3/006* (2013.01); *B61L 3/008* (2013.01); *B61L 15/009* (2013.01);
(Continued)

(58) Field of Classification Search
CPC .. B61L 3/00; B61L 3/006; B61L 3/008; B61L 5/00; B61L 5/0072; B61L 5/009; B61L 27/00; B61L 27/0027; B61L 99/00
See application file for complete search history.

(56) References Cited

U.S. PATENT DOCUMENTS 8,386,281 B2 * 2/2013 Goodermuth ..... G06Q 10/063 246/1 C
2004/0167687 A1 * 8/2004 Kornick ..... B61L 3/127 701/19
(Continued)

FOREIGN PATENT DOCUMENTS

CN 2592469 Y 12/2003
CN 1750960 A 3/2006
CN 202294881 U 7/2012

OTHER PUBLICATIONS

Winter J. et al; " Fahrerassistenz-System", ( Driver Assistance) Signal + Draht Telzlaff Verlag GmbH, Darmstadt; vol. 101; No. 10; pp. 6-10; ISSN: 0037-4997; XP001548183; 2009.

*Primary Examiner* — Jason C Smith
(74) *Attorney, Agent, or Firm* — Laurence Greenberg; Werner Stemer; Ralph Locher

(57) ABSTRACT

An apparatus for generating action recommendations for the driver of a rail vehicle includes a device that can be carried by the driver in order to provide a type of apparatus that can be retrofitted quickly and easily to an existing rail vehicle. The device has at least one data interface unit for receiving basic data, a memory unit for storing at least one program module, a processing unit provided for executing the program module in order to generate the action recommendations at least on the basis of the basic data, and an output unit for outputting the action recommendations. A rail vehicle having the apparatus is also provided.

7 Claims, 2 Drawing Sheets

(51) Int. Cl.
*B61L 15/00* (2006.01)
*B61L 27/00* (2006.01)

(52) U.S. Cl.
CPC ..... *B61L 15/0072* (2013.01); *B61L 27/0027* (2013.01)

(56) References Cited

U.S. PATENT DOCUMENTS

2010/0185472 A1* 7/2010 Goodermuth ..... G06Q 10/063 705/7.11
2012/0130568 A1* 5/2012 Golden ..... B61L 15/0072 701/20
2016/0107665 A1* 4/2016 Dommel ..... B61L 3/006 246/1 R

* cited by examiner

APPARATUS FOR GENERATING ACTION RECOMMENDATIONS FOR THE DRIVER OF A RAIL VEHICLE

BACKGROUND OF THE INVENTION

Field of the Invention

The invention relates to an apparatus for generating action recommendations for the driver of a rail vehicle.

Assistance systems for drivers of rail vehicles are known. The purpose of these systems is to generate an action recommendation for an energy-optimized manner of driving on the basis of static and dynamic data relating to the line, timetable and vehicle, and to output said recommendation.

Such systems are conventionally integrated in the overall vehicle control system. Program modules are executed in a central control unit and, if applicable, in local control units which are permanently embedded in the rail vehicle, in particular as embedded hardware. Recommendations are output via a display device (also known as an "HMI") which is connected to a vehicle bus (e.g. a "Multifunction Vehicle Bus" or MVB) and is fixed to a driver console.

If an existing rail vehicle is meant to be retrofitted with the functions of a driver assistance system, then the devices mentioned above need to be modified, involving time-consuming re-approval of the rail-vehicle control system, which comes at a cost.

BRIEF SUMMARY OF THE INVENTION

The object of the invention is to provide an apparatus for generating action recommendations for the driver of a rail vehicle and which can be retrofitted in an existing rail vehicle quickly and easily.

For this purpose it is proposed that the apparatus comprises a device which can be carried by the driver and which comprises at least one data interface unit for receiving base data, a memory unit for storing at least one program module, a processing unit for executing the program module in order to generate the action recommendations at least on the basis of the base data, and an output unit for outputting the action recommendations. The device advantageously contains the vehicle-based architecture needed for generating the recommendations, which means that the architecture is centralized in a unit that is preferably decoupled from the permanently embedded vehicle control system. An existing rail vehicle can hence be retrofitted quickly and easily because the required functions can be implemented preferably without intervening in the vehicle control system. The device advantageously comprises a continuous enclosure that encompasses this architecture.

By virtue of the device being designed as a portable unit, the apparatus can also be installed easily and can be used extremely conveniently. A "portable" device shall be understood to mean a device that in terms of its weight, shape and dimensions is suitable to be held and carried in one hand and/or carried on the body. In particular, the device can be designed so that it can be tucked away in a piece of clothing. The device can advantageously remain in the possession of a driver throughout a service assignment, wherein the driver carries the device with him when entering the rail vehicle at a starting point and when leaving the rail vehicle at a destination. If the driver is meant to drive a plurality of rail vehicles during one service assignment, the driver can use the device for all the journeys.

The action recommendations are generated by the processing unit "on the basis of the base data" by this base data being incorporated directly by the processing unit in the execution of the program module and/or the base data being used to determine data which is incorporated by the processing unit in the execution of the program module. Determining this data can also be part of the program module.

The data interface unit advantageously receives the base data via a connection, in particular a wireless connection, which can preferably be established directly, i.e. excluding an on-board network, to an off-board installation. The device can thereby be designed such that it is independent of the vehicle control system as regards data communication.

The action recommendations can be output by the output unit by visual, acoustic and/or haptic means.

In a preferred embodiment of the invention it is proposed that the device is in the form of a mobile phone. This allows the use of conventional, widely available and low-cost equipment. In particular there are commercially available mobile phones that have a processing unit suitable for efficient execution of the program module.

Alternatively or additionally, the device can be in the form of a tablet computer.

It is also proposed that the data interface unit comprises a receiver for receiving positioning data. Base data which is used as dynamic data and/or for calculating dynamic data can be received easily by this means. "Dynamic" data shall be understood to mean particularly data that characterizes a current journey of the rail vehicle along a specific line. In particular, this dynamic data may be current position information, for instance particularly a current position along the line or a current distance from a starting point and/or destination, or current movement information, for instance particularly a current speed, a current acceleration etc. The receiver is intended in particular for receiving positioning data via a wireless data connection.

In an advantageous development of the invention it is proposed that the data interface unit comprises a transceiver for establishing data communication via an off-board data network. This allows rapid access to a large amount of data. Base data, which is used as framework data and/or for calculating dynamic data, can be received easily. "Framework data" shall be understood to mean data which characterizes in particular a line to be traveled or currently being traveled by the rail vehicle, a timetable to be followed along the line, and/or the rail vehicle. The framework data is preferably known before leaving a line starting point and may be updated during the journey if applicable. A data connection to the off-board data network such as the Internet, for instance, can be made in particular via a mobile communication network or a WLAN installation, e.g. in a railway station area.

It is proposed in particular that the memory unit comprises at least one memory area for storing base data obtained from the data network. By storing this data in the device, the processing unit can quickly access this data, particularly framework data such as timetable data, line data or vehicle data. Alternatively or additionally, base data can be obtained from the data network during execution of the program module.

It is also proposed that in a download mode, the device is intended to obtain at least part of the program module from the data network, and to store same in a memory area of the memory unit. The program module can thereby be installed and/or updated easily.

The apparatus preferably comprises a retaining device for fixing the device to an element of a driver cab, so that it can thereby be used even more conveniently.

BRIEF DESCRIPTION OF THE SEVERAL VIEWS OF THE DRAWING

An exemplary embodiment of the invention is described in greater detail with reference to the drawings, in which.

DESCRIPTION OF THE INVENTION

Figure 1:
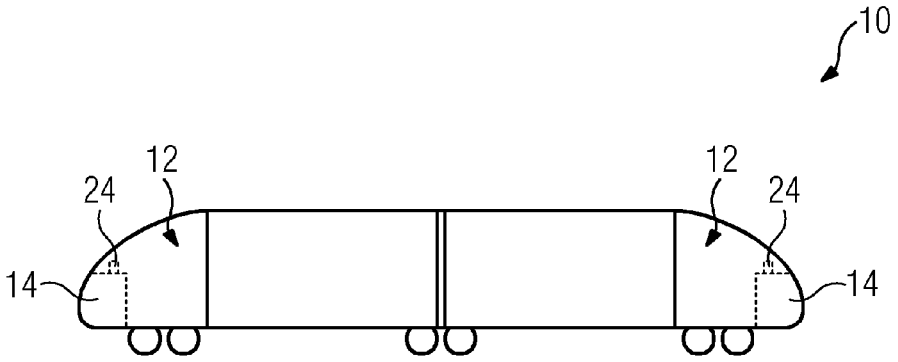
FIG. 1 is a schematic side view of a rail vehicle having two driver cabs.

FIG. 1 shows a schematic side view of a rail vehicle 10 in the form of a multiple unit train. A driver cab 12 is arranged at each end of the rail vehicle 10. This cab is equipped in a known manner with a control console 14 (also called a "driver console"), which comprises operator controls 16 that can be operated by the driver of the rail vehicle 10 (see FIG. 2). These operator controls 16 can be used for a plurality of actions relating to controlling an operation of the rail vehicle 10, in particular actions such as initiating acceleration in accordance with preset levels for a driving operation, returning to a neutral mode for rolling operation or initiating a braking operation of the rail vehicle 10.

Figure 2:
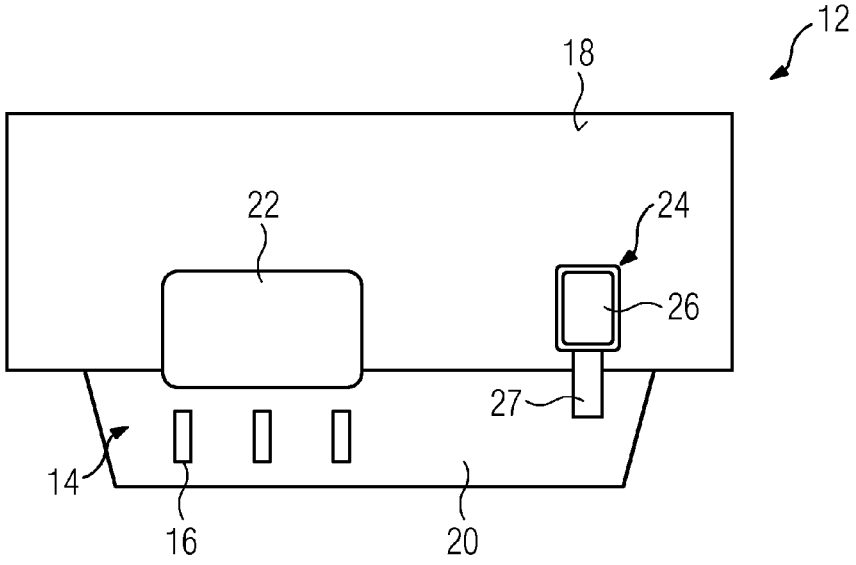
FIG. 2 is a front view of a driver console in one of the driver cabs.

FIG. 2 shows in a highly schematic form a front view of the control console 14 of one of the driver cabs 12. This unit adjoins a windshield 18 and comprises the operator controls 16 and a display device 22 fastened to a main body 20 of the control console 14. It is intended to remain fixed to the main body 20 for operation of the rail vehicle 10, and is fitted to the main body during manufacture of the rail vehicle 10. The display device 22 is detached from the main body 20 solely for replacement and/or maintenance purposes.

The driver cab 12 also contains a device 24 for generating action recommendations for the driver of the rail vehicle 10. The device 24 is a device that can be carried by the driver and in the embodiment being considered is in particular in the form of a mobile phone. The device 24 comprises an output unit 26 in the form of a display, and is held in a position by a retaining device 27 such that the output unit 26 is situated in the field of view of the driver when the driver is sitting at the control console 14 in order to operate the operator controls 16. The retaining device 27 is mechanically connected to the main body 20. The driver can attach the device 24 to the retaining device 27 and detach it therefrom at any time without the operation of the rail vehicle 10 being affected by this detachment. The main body 20 forms a possible element of the driver cab 12 to which the retaining device 27 can be connected. In an alternative embodiment, it is possible that the retaining device 27 can be connected to a further element such as the windshield 18 in particular. The retaining device 27 can have a suction pad in this case.

Figure 3:
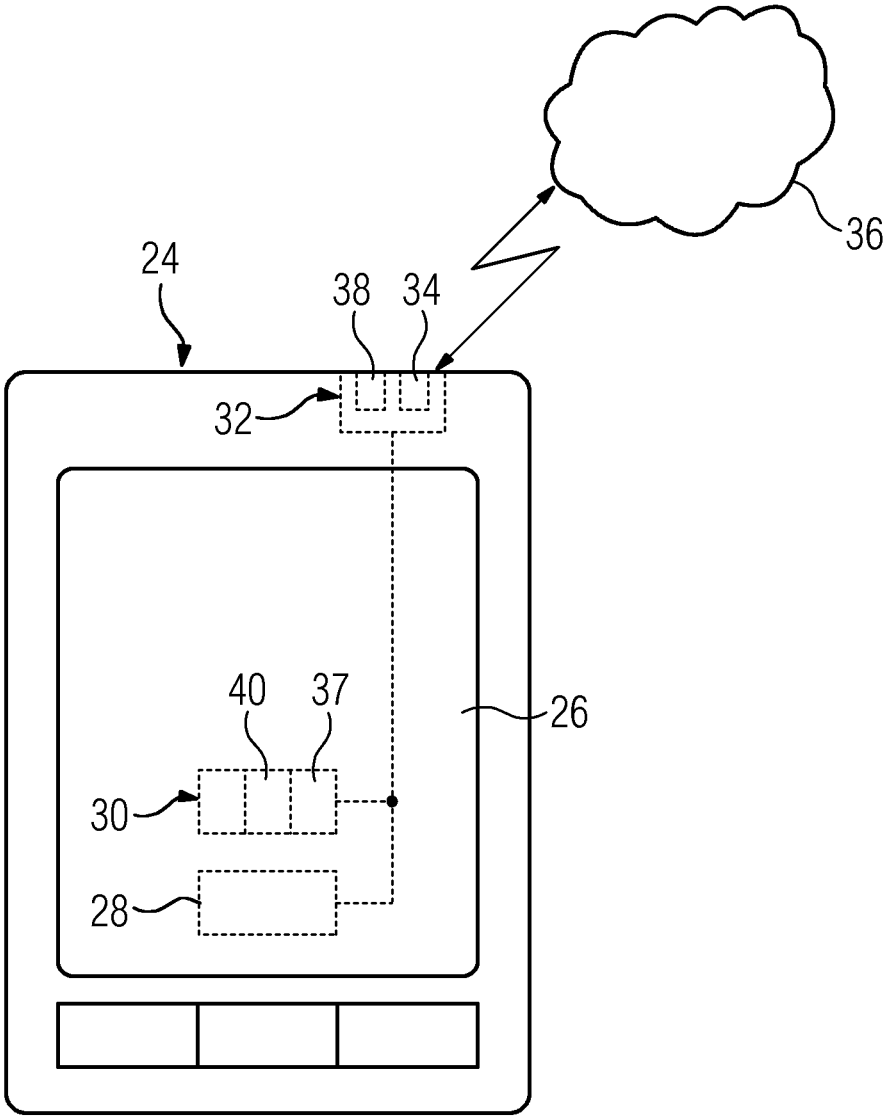
FIG. 3 shows a portable device for generating and displaying recommendations for a driver.

FIG. 3 shows a detailed view of the device 24. The device is intended to generate action recommendations for the driver and to use the output unit 26 to output, in particular to display, these recommendations. The device 24 comprises a processing unit 28 for this purpose, which comprises a processor unit containing one or more processor cores. In order to generate the action recommendations, the processing unit 28 executes a program module that is stored in a memory unit 30 of the device 24.

The action recommendations are generated on the basis of data that are used by the processing unit 28. This data can be divided into a first group and a second group. The first group is formed of framework data. This first group in particular comprises timetable data, particularly arrival, departure and journey times, line data, particularly distances, gradients, tunnel positions and tunnel cross sections, curve radii, switch position, maximum permitted speed etc., and vehicle data. Data in the first group can be received as base data by a data interface unit 32 of the device 24. The data interface unit 32 comprises for this purpose a transceiver 34 for establishing data communication via an off-board data network 36, e.g. via the Internet. After being received, data in the first group can be stored in the memory unit 30 and provided for access by the processing unit 28 for subsequent generation of recommendations. A statically or dynamically allocated memory area 37 of the memory unit 28 is provided for storing the data in the first group.

Alternatively or additionally, data in the first group can be downloaded from the data network 36 while the recommendations are being generated. It is also possible that a subset of the first group of data is received as base data by the data interface unit 32, while another subset of the first group is determined by the processing unit 28 from this base data and/or from data in the second group described below, said determined data being used by the processing unit 28 in generating the recommendations.

In addition to this first group, the recommendations are generated on the basis of a second group of data, which is formed from dynamic data, in particular data such as the current position of the rail vehicle 10, the current speed of said vehicle and the current distance from the starting point and/or destination. Data in the second group can be received as base data by the data interface unit 32 of the device 24. The data interface unit 32 comprises for this purpose a receiver 38 for receiving positioning data. For instance the receiver 38 may be in the form of a GPS receiver. Alternatively or additionally, the receiver 38 can be provided to acquire a piece of positioning information via a device located on the line, for instance using ground-based balises or a train protection system. A subset of the second group of data can be received as base data via the data interface unit 32, while another subset of the second group is determined by the processing unit 28 from this base data and/or from data in the first group, said determined data being used by the processing unit 28 in generating the recommendations.

The generation of a recommendation about a preferred manner of driving is based on a mathematical optimization model, which calculates an energy-optimized manner of driving, e.g. an energy-optimized speed or an energy-optimized driving mode (accelerations, braking, rolling operation) for specific line sections. The program module stored in the memory unit 30 is composed at least of coding of the mathematical model. When a download mode is implemented during a first installation or an update via the transceiver, the program module can be obtained by the device 24 from the data network 36 via the transceiver 34 and stored in a memory area 40 of the memory unit 28. According to a particular implementation of the download mode, in particular for the purpose of an update, it is possible to obtain only some of the program module.

By the output of a recommendation, the driver is notified of, for example, the speed at which the vehicle is meant to travel, at what time a change in speed occurs, or what driving phase (acceleration, rolling, braking) shall be given preference. For instance the driver can be recommended to operate an operator control 16 for returning to a neutral mode for a rolling operation of the rail vehicle 10.

The invention claimed is:

1. An apparatus for generating action recommendations for the driver of a rail vehicle, the apparatus comprising:

a device which can be carried by the driver, said device including:

at least one data interface unit for receiving base data, said at least one data interface unit including a receiver for receiving positioning data, the positioning data characterizing a current journey of the rail vehicle along a specific line, a memory unit for storing at least one program module, a processing unit for executing the program module in order to generate the action recommendations at least based on the base data, and an output unit for outputting the action recommendations.

2. The apparatus according to claim 1, wherein said device is a mobile phone.

3. The apparatus according to claim 1, wherein said data interface unit includes a transceiver for establishing data communication over an off-board data network.

4. The apparatus according to claim 3, wherein said memory unit includes at least one memory area for storing base data obtained from the data network.

5. The apparatus according to claim 3, wherein said memory unit has a memory area, and said device, in a download mode, is configured to obtain at least part of the program module from the data network and to store the at least part of the program module in said memory area.

6. The apparatus according to claim 1, which further comprises a retaining device for fixing said device to an element of a driver cab of the rail vehicle.

7. A rail vehicle, comprising an apparatus according to claim 1.

* * * * *